US006270091B1

(12) United States Patent
Smith

(10) Patent No.: US 6,270,091 B1
(45) Date of Patent: Aug. 7, 2001

(54) ARTICULATED TWO-PIECE SNOWBOARD WITH CONNECTOR

(76) Inventor: Shane H. Smith, 433 Northern Cross, Big Bear Lake, CA (US) 92315

( * ) Notice: Subject to any disclaimer, the term of this patent is extended or adjusted under 35 U.S.C. 154(b) by 0 days.

(21) Appl. No.: 09/465,543

(22) Filed: Dec. 16, 1999

Related U.S. Application Data

(60) Provisional application No. 60/112,744, filed on Dec. 17, 1998.

(51) Int. Cl.[7] ..... B62B 9/04

(52) U.S. Cl. ..... 280/14.21; 280/603; 280/609; 280/15

(58) Field of Search ..... 280/602, 603, 280/609, 606, 14.1, 14.2, 12.1, 16, 15, 22, 28, 842, 20, 610; D21/229

(56) References Cited

U.S. PATENT DOCUMENTS

| | | | | |
|---|---|---|---|---|
| 3,628,804 | * | 12/1971 | Carreiro . | |
| 3,782,744 | * | 1/1974 | Milovich et al. | 280/12.1 X |
| 4,083,577 | * | 4/1978 | Ford | 280/609 |
| 4,163,565 | * | 8/1979 | Weber | 280/16 |
| 4,243,238 | * | 1/1981 | Johnson | 280/22 X |
| 4,305,603 | * | 12/1981 | Muller et al. | 280/607 |
| 4,533,150 | * | 8/1985 | Hardy | 280/609 X |
| 4,974,868 | * | 12/1990 | Morris | 280/609 |
| 5,026,088 | * | 6/1991 | Stuart | 280/14.2 X |
| 5,090,722 | * | 2/1992 | Ritchie et al. | 280/14.2 X |
| 5,135,249 | * | 8/1992 | Morris | 280/609 |
| 5,320,378 | * | 6/1994 | Wiig | 280/14.2 X |
| 5,328,200 | * | 7/1994 | Pelizzari | 280/609 |
| 5,462,304 | * | 10/1995 | Nyman | 280/609 |
| 5,538,272 | * | 7/1996 | Peart | 280/602 |
| 5,580,078 | * | 12/1996 | Vance | 280/609 X |
| 5,799,956 | * | 9/1998 | Shannon | 280/14.2 |
| 5,865,446 | * | 2/1999 | Kobylenski et al. | 280/14.2 |
| 6,053,513 | * | 4/2000 | Dickinson | 280/14.2 |
| 6,105,979 | * | 8/2000 | Descrochers . | |

FOREIGN PATENT DOCUMENTS

| | | | |
|---|---|---|---|
| 778053 | * | 6/1997 | (EP) . |
| 846479 | * | 6/1998 | (EP) . |

* cited by examiner

*Primary Examiner*—Brian L. Johnson
*Assistant Examiner*—Bryan Fischmann
(74) *Attorney, Agent, or Firm*—Edgar W. Averill, Jr.

(57) ABSTRACT

A snowboard having a front section connected to a back section by a bendable connector. A rider places one foot on the front section and the other foot on the back section. The bottom of both sections have a series of curved longitudinal ridges positioned so that the bottom of each section curves in a convex manner both front to back and side to side. The rider's feet may be restrained from horizontal movement along the top surface by a recess in the top surface or by protrusions in the top surface.

20 Claims, 18 Drawing Sheets

ARTICULATED TWO-PIECE SNOWBOARD WITH CONNECTOR

CROSS REFERENCE TO RELATED APPLICATION

This application claims the benefit of Provisional Patent Application Ser. No. 60/112,744, filed Dec. 17, 1998.

BACKGROUND OF THE INVENTION

The field of the invention is sporting goods and the invention relates more particularly to showboards.

In the past, commercial snowboards have comprised a single surface equipped with forward and rear bindings for attaching the user's boots to the snowboard. Prior one-piece snowboards have been limited in their ability to make sharp turns and maneuver over uneven surfaces and around moguls. In addition, they are awkward to store and transport.

U.S. Pat. No. 5,865,446 to Kobylenski et al, Jun. 6, 1996 attempted to address the limitations of the one-piece snowboard by creating an articulated two-piece snowboard that looks very much like a traditional snowboard cut in half and connected with flexible straps. Although the flexible connection appears to give the snowboard some additional maneuverability over a one-piece board by making one board into two shorter boards, the flexible connection results in some significant maneuverability issues.

The bottom of the board is flat like a traditional, one-piece snowboard, so that each section still has problems moving over and around bumps and uneven surfaces. In addition, and most importantly, the snowboard still must be maneuvered using the edge of the board for turning and direction in a manner similar to the one-piece snowboard. This makes the snowboard less controllable using the stated design than one-piece snowboards for the following reason: by creating a flexible connection, the rider must now contend with two edges, one on each section. To maximize control, the full edge of each section needs to be in contact with the surface of the snow. In order for this to happen, the edges must remain in a straight line. This will require substantial effort on the part of the rider and the sections will normally not remain in a straight line.

The rider has two options when entering a turn, neither optimal. In the first, the forward foot will be angled into the turn while the trailing foot will tend to be pointed in the original direction. The weight will be on the front foot to make the turn, engaging the full edge of the front section, but with reduced effectiveness, since the edge of the back section is used only minimally—the turn is being performed primarily by the edge of the front section. If the rider inadvertently shifts his weight to the back section, that section will want to maintain the original direction and the board could easily become uncontrollable. In the second method of making the turn the rider will have more equal weight on both sections, and the angle between the longitudinal axis of both sections will be less than 180 degrees on the side that is being turned toward. The problem with this approach is that only a fraction of the full edge of both sections will be engaged. This will result in decreased turning performance when compared to a one-piece snowboard.

The primary advantage becomes the primary disadvantage, since the flex in the middle prevents full engagement of both sections' edges. In summary, the use of a two-piece snowboard with a flexible connector while retaining the same turning method that is used in the one-piece snowboard, is a serious flaw in the Kobylenski design.

In addition, the Kobylenski design secures both feet to the snowboard like the traditional one-piece snowboards. This decreases rider mobility and increases risk of injury.

The present invention introduces an entirely new design for snowboards, comprising two sections with a uniquely shaped convex bottom and joined with a connector. Quite different than the traditional flat-surfaced bottom, the bottom surface of the snowboard of the present invention is not only convex front-to-back like the traditional snowboard, but also side-to-side, much like the shape of a rounded hull of a boat or the underside of a spoon. This allows it to move around and through rough, bumpy surfaces, including moguls. The convex bottom has one or more ridges which are used to maneuver and turn the board. The edge of the board is no longer the primary means of turning the board. The ridges are strategically placed on the bottom surface to accommodate various types of terrain and ride. Angled blades can be incorporated in the bottom surface for more aggressive turning capability. In the preferred embodiment, a springable connector forces the rear section to follow the front section in a turn, placing the ridges on the bottom surface of both sections in an optimal turning configuration.

Since the edge of the board is not used for turning and maneuvering, the rider is freed from the requirement of rigidly securing his feet to the invention with a binding, since it is no longer necessary to use secured feet to turn the board on its edge. Instead, the rider can ride the invention with maximum freedom of foot movement and little or no securing of the feet to the surface of each section.

The sections can be disconnected for easy transport and storage. A user can customize and modify the performance of the invention by: (a) interchanging sections with sections of differing physical and performance characteristics (b) changing or moving ridges or blades on a section and/or (c) changing to a different style of connector for joining the two sections.

BRIEF SUMMARY OF THE INVENTION

The present invention is an articulated, two-piece snowboard with separate front and rear sections joined together with a connector, each section providing a platform for one foot. In the preferred embodiment, the bottom surface of the sections are convex, with longitudinal ridges along the bottom; the sections are connected with a springable connector. The sections may be detached from the connector for the purpose of transporting the invention or for the purpose of substituting a section with different characteristics.

DESCRIPTION OF THE PREFERRED EMBODIMENTS

Figure 1:
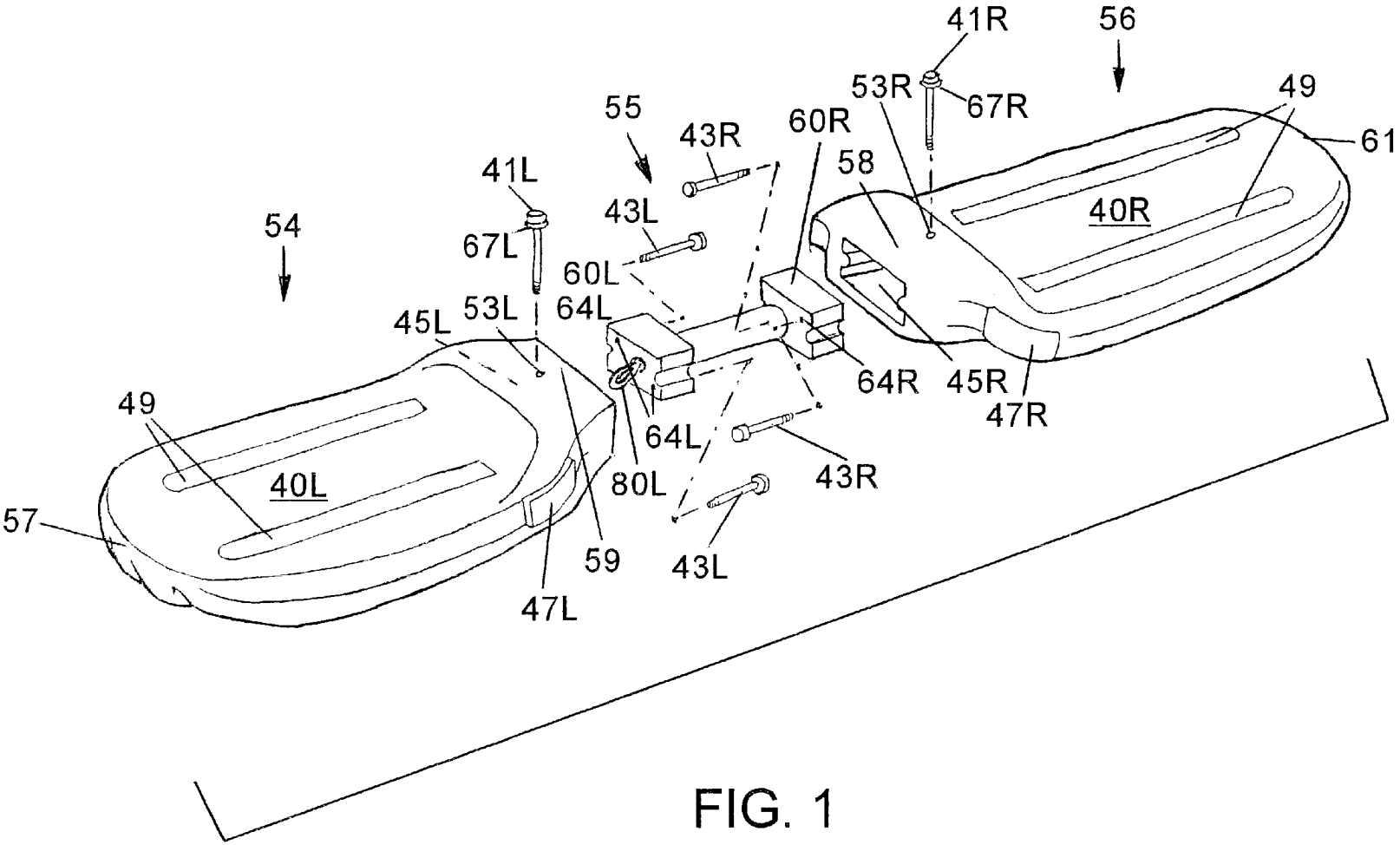
FIG. 1 is an exploded perspective view of the present invention.

A preferred embodiment of the present invention as best shown in FIG. 1, comprises a front section 54 and a rear section 56 joined with a springable connection assembly 55. Although front section 54 and rear section 56 are depicted as identical, they may differ in size, shape or construction to alter the performance characteristics of the invention. The rider of the invention will place one foot on section 54 and one foot on section 56, preferably with feet at angles to the longitudinal axis in a stance similar to that used by traditional snowboarders.

Connection of the Three Primary Parts of the Invention: Front Section, Rear Section and Springable Connection Assembly.

FIG. 1 illustrates how the three primary pieces of the invention, the front section, the rear section and the springable connection assembly, are attached to one another. To connect the front section and the rear section to the springable connection assembly, block 60R, preferably rectangular, is inserted into a slot, hollow or mating cavity 45R and block 60L is inserted into the slot, hollow or mating cavity 45L. Block 60L is primarily secured by two bolts 43L which are inserted into two holes 64L in the block and into threaded sleeves or holes in the wall of the mating cavity 45L. In addition, a bolt 41L is inserted through washer 67L into sleeve or hole 53L, where it passes through loop 80L of the connection assembly and into a threaded receptacle and tightened. The purpose of bolt 41L is to prevent separation of section 54 from the connection assembly in the event that bolts 43L fail under stress. In the same manner, block 60R is primarily secured by two bolts 43R which are inserted into two holes 64R in the block and into threaded sleeves or holes in the wall of the mating cavity 45R. In addition, a bolt 41R is inserted through washer 67R into sleeve or hole 53R, where it passes through loop 80R of the connection assembly and into a threaded receptacle and tightened. The purpose of bolt 41R is to prevent separation of section 54 from the connection assembly in the event that bolts 43R fail under stress.

Front Section: Shape and Outer Surface

Figure 2:
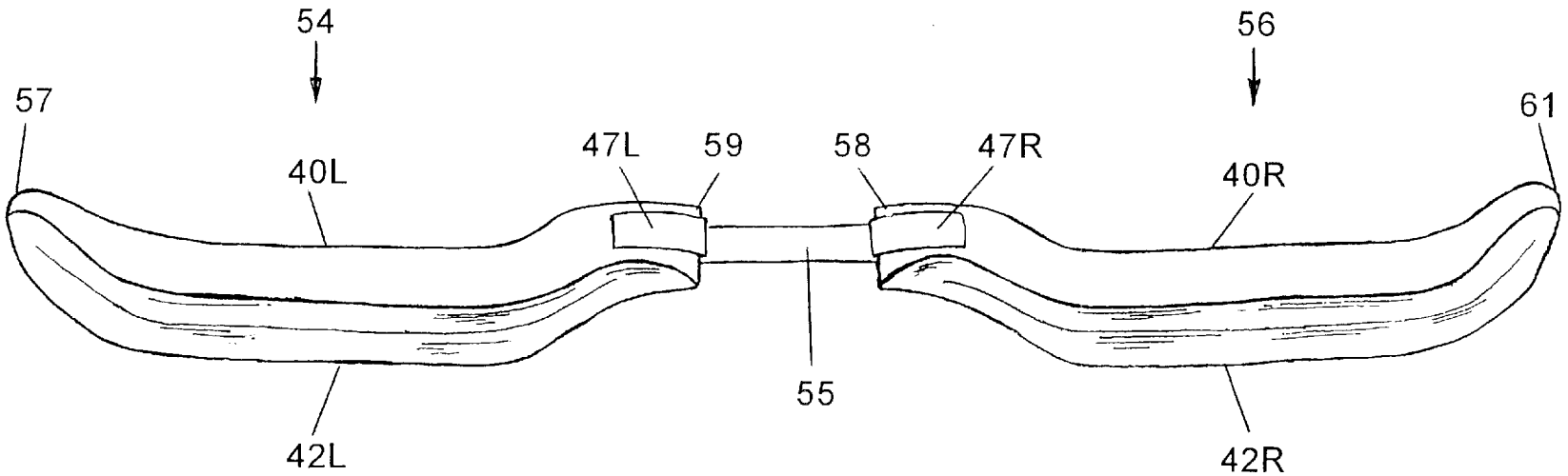
FIG. 2 is a side view of the present invention.

The front section has a convex-shaped bottom. The bottom surface of the section is not only convex parallel to the longitudinal axis as shown in FIG. 2, it is also preferably convex perpendicular to the longitudinal axis, as shown in cross-section view FIG. 8. This would usually mean that the lowest part 66 of the bottom surface is lower than the outside edges 63 of the bottom surface. The outside edges 63 are usually rounded or curved upward to prevent the edges 63 from digging into the snow, except when usage may require less rounding and more of a sharp or pointed edge, such as for steep terrain or stunt riding. The leading edge 57 in FIG. 2 is curved upward somewhat. The top surface 40L of said front section is used as a platform for one of the rider's feet. Two rigid strips 49, shown in FIG. 1, preferably metal, are connected to the top surface 40L with screws or other connectors. Said strips provide longitudinal reinforcement for said section. The trailing edge 59 of the front section curves upward and then flattens as it forms the upper surface of a mating cavity 45L; said mating cavity is a receptacle for block 60L of the connection assembly 55.

Front Section: Bottom Surface

Figure 3:
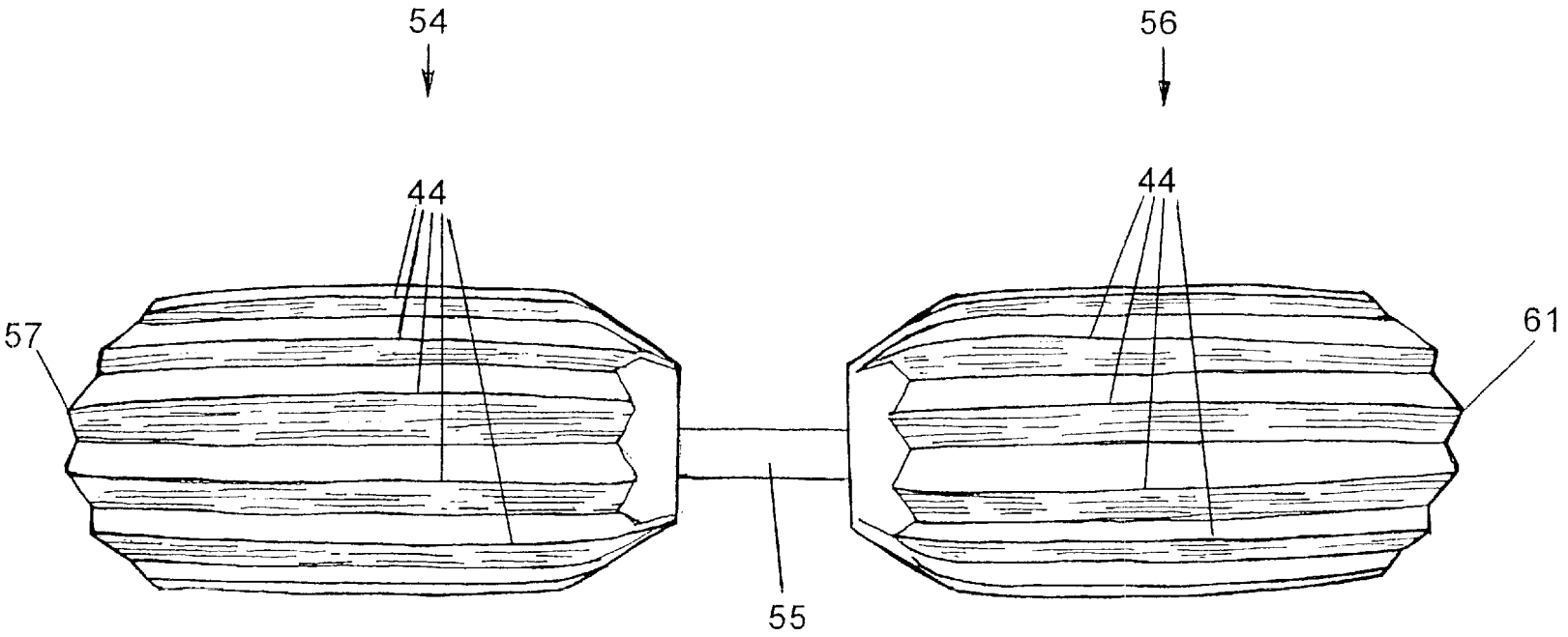
FIG. 3 is a bottom view towards the bottom surface of the present invention.

The bottom surface 42L of the invention is best shown in FIG. 3. Ridges or protrusions 44 extend longitudinally along the bottom surface. The triangular shape of the ridges 44 are shown in cross section view FIG. 8. (To better describe the shape of the ridges: if you were to extrude a triangle and place one of the flat surfaces of the three-sided extrusion against the bottom surface of the section, running lengthwise, you would then have a ridge.) The number of ridges can be varied in order to modify the performance characteristics of the invention.

Figure 8:
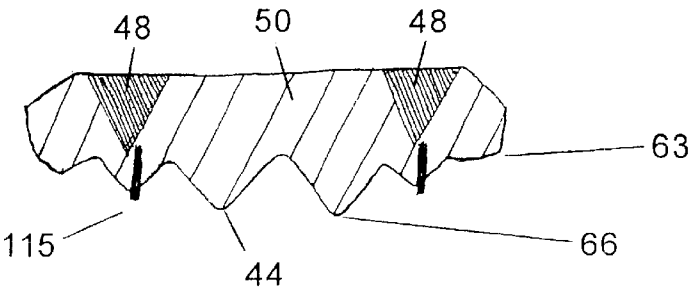
FIG. 8 is a sectional view taken on the line 8—8 of FIG. 7.

In addition, the ridges themselves can vary. An alternate embodiment of a ridge is depicted in FIG. 8, where a blade 115, made of metal or other hard material, protrudes from the bottom of one or more ridges to provide additional "bite" and improved control. Longitudinal blades facilitate movement in a direction parallel to the longitudinal axis of the section.

Figure 4:
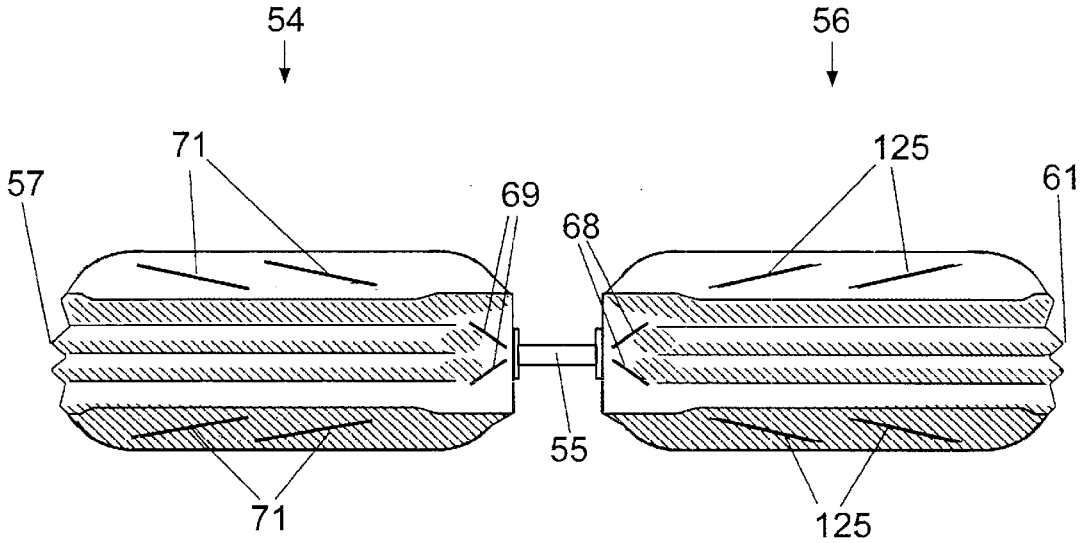
FIG. 4 is a bottom view illustrating turning blades of the present invention.
Figure 5:
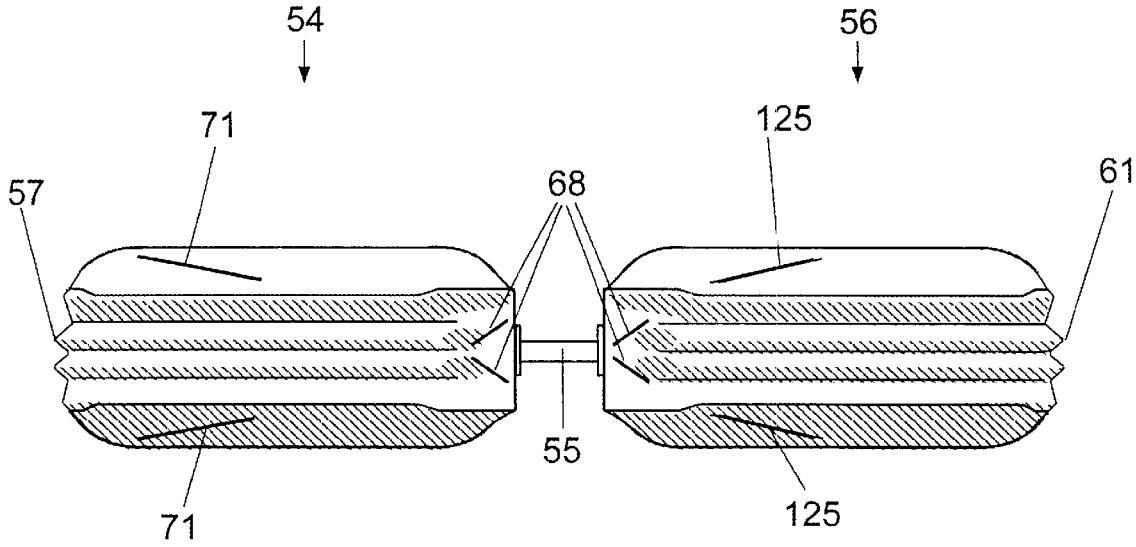
FIG. 5 is a bottom view illustrating turning blades of the present invention.
Figure 6:
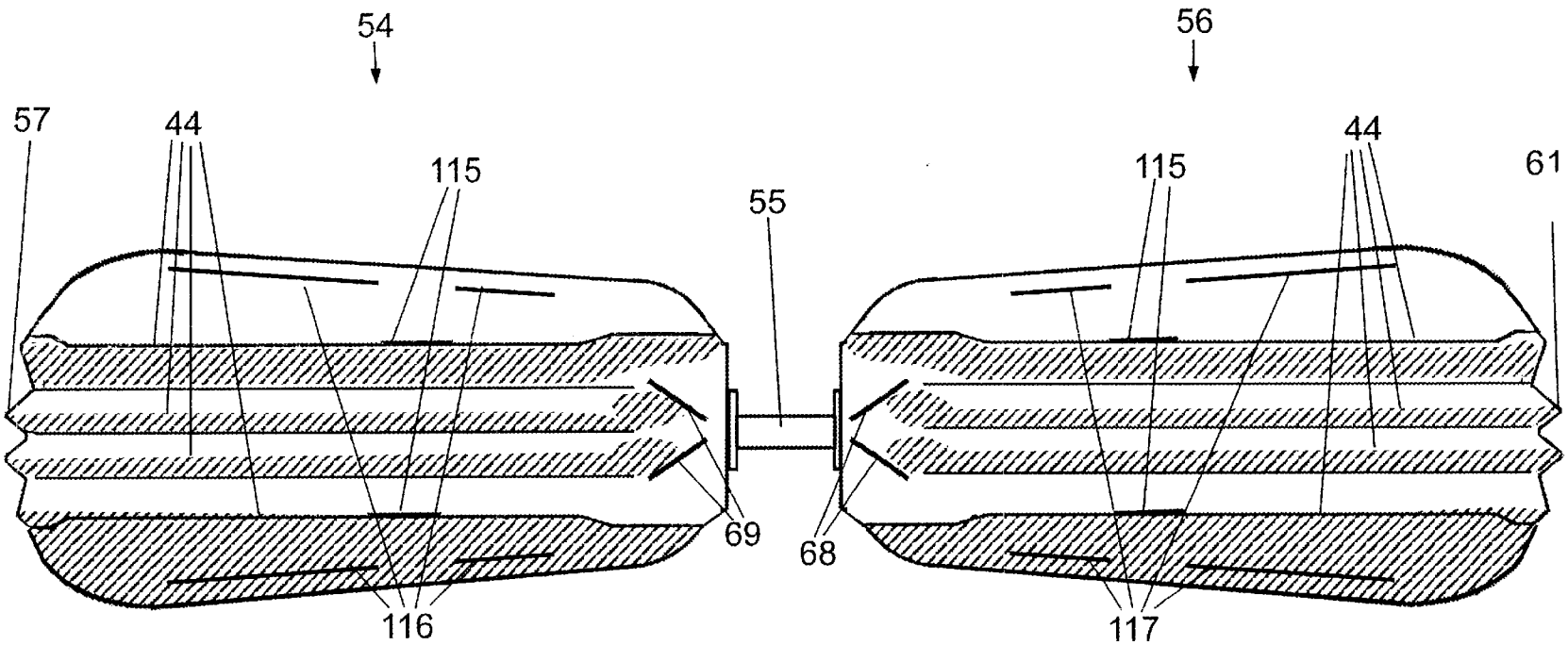
FIG. 6 is a bottom view illustrating a tapered shape of the present invention.

Blades may also be used to aid in turning and/or stopping, and are usually placed on the periphery of the sections. FIGS. 4, 5 and 6 illustrate placement of blades and ridges. FIG. 4 shows two sets of turning blades, 71 and 125. Angled out blades 71 are pointed away from the longitudinal axis of the section to facilitate the turning of the front section in the direction of the turn. For example, the front section will turn right in a right-hand turn. Angled in blades 125 on the rear section are pointed towards the longitudinal axis of the board so that the rear section will tend to turn in the direction away from the turn. For example, the rear section will tend to turn left in a right-hand turn, which places the invention in a curve to the right, and facilitates the turn. FIG. 4 also shows two sets of stopping blades. Angled out stopping blades 69 have more stopping power than angled in stopping blades 68.

FIG. 5 shows one right turning blade on each section and one left turning blade on each section, rather than the two blades per side per section as shown in FIG. 4.

FIG. 6 depicts turning blades that are parallel to the sides of the sections, but since the sections are themselves slightly angled, this results in the blades 116 angled out and the blades 117 angled in, resulting in the same functionality as the boards in FIG. 4 and FIG. 5, with the additional advantage of the board shape working with the turning blades to further facilitate turns.

In all cases of ridges and blades, the convexness of the bottom surface perpendicular to the longitudinal axis combined with the ridges, including longitudinal, turning or stopping ridges, are some of the key differences between this invention and traditional snowboards or skis.

Front Section: Spacers

Figure 7:
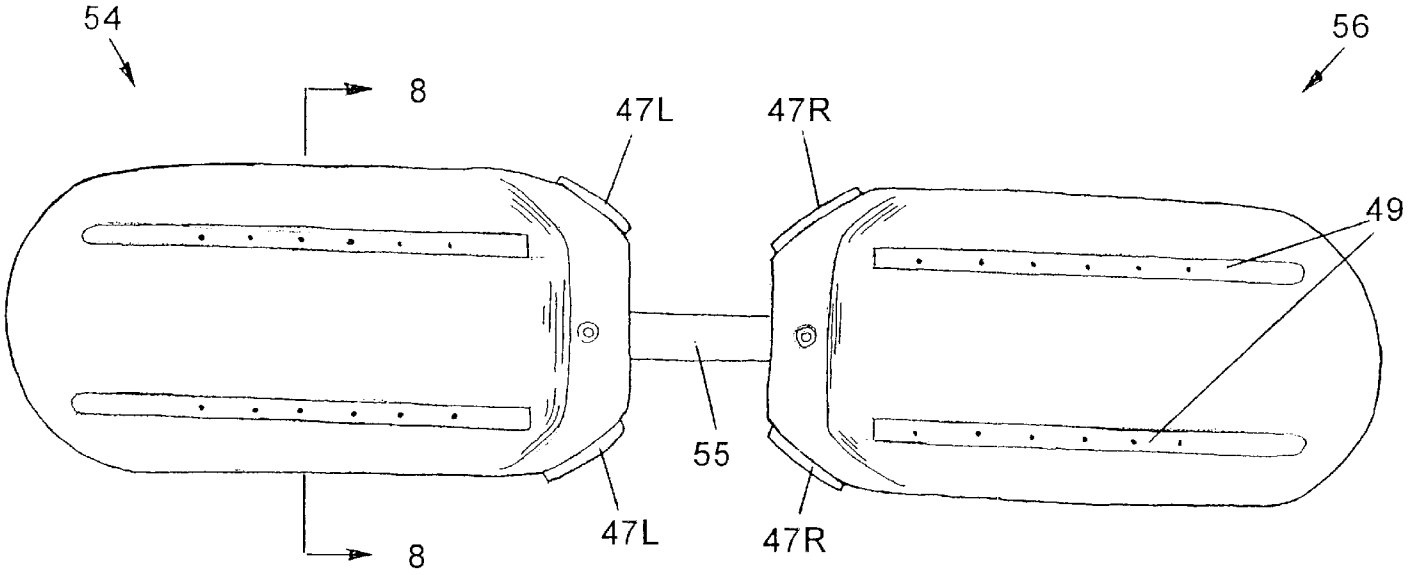
FIG. 7 is a top view plan of the present invention.

FIGS. 1 and 7 show bumpers or spacers 47L, located on the sides of the trailing edge of the front section. The spacers are preferably constructed of hard, resilient material such as a hard rubber or similar material.

Front Section: Internal Construction

Figure 12:
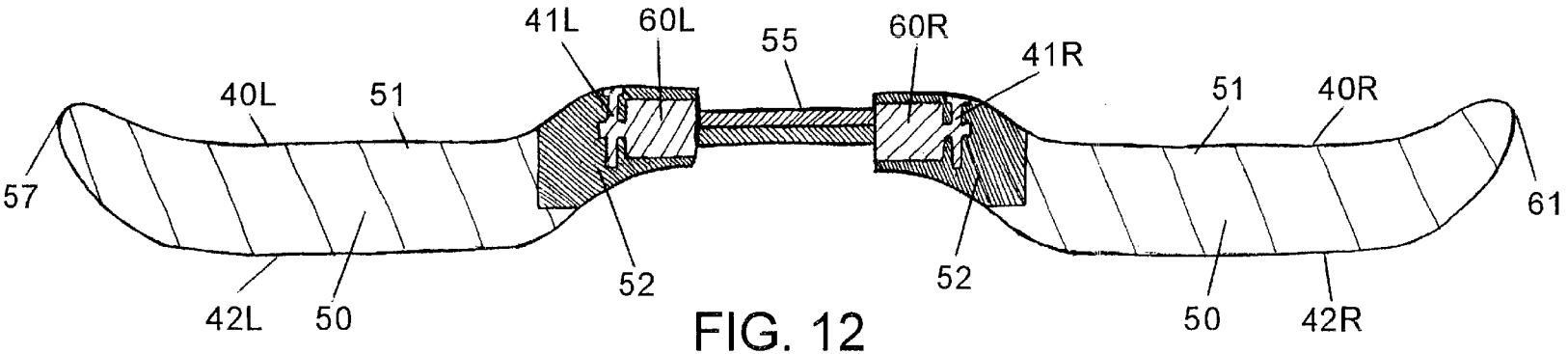
FIG. 12 is a sectional view taken on the line 12—12 of FIG. 11.
Figure 13:
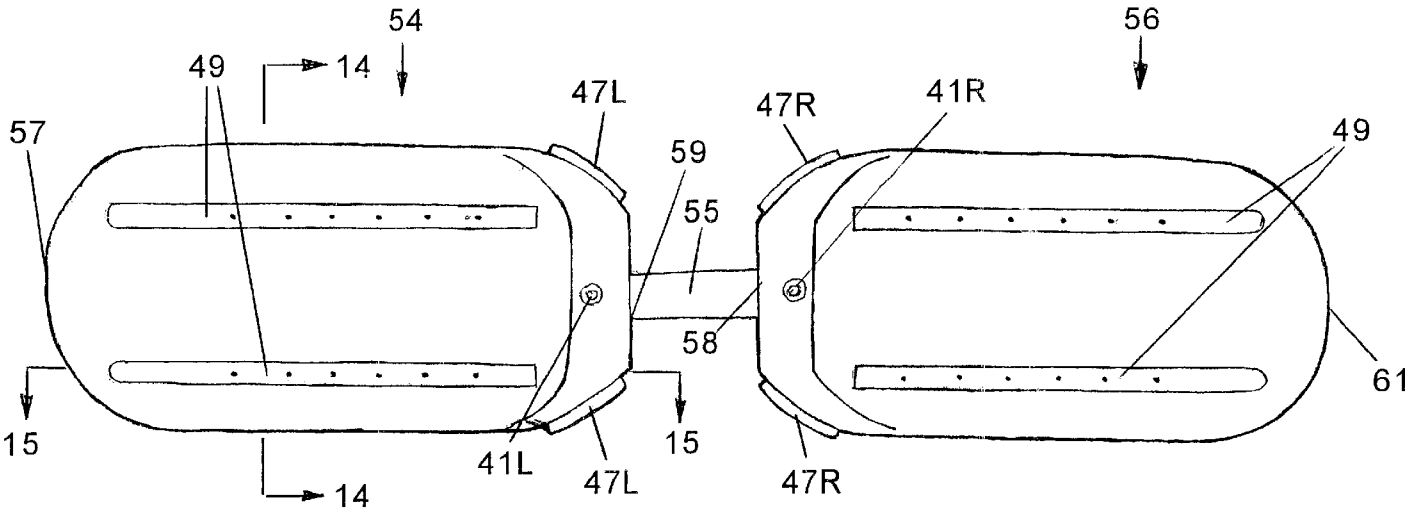
FIG. 13 is a plan view of the present invention.
Figure 15:
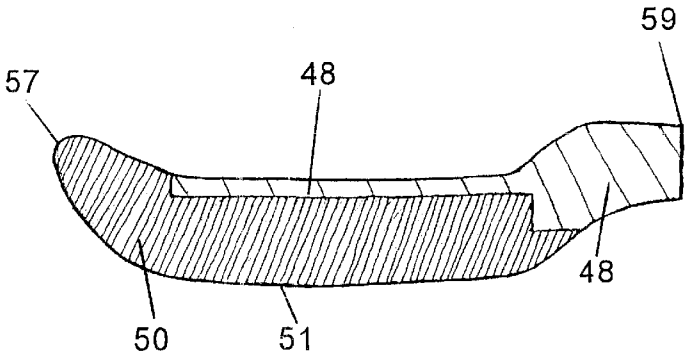
FIG. 15 is a cross-sectional view on the line 15—15 of FIG. 13, showing reinforced areas.
Figure 14:
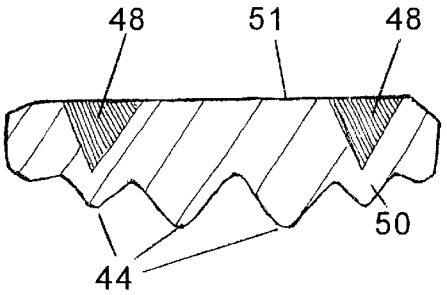
FIG. 14 is a cross-sectional view on the line 14—14 of FIG. 13, showing reinforced areas.

FIGS. 12, 14 and 15 illustrate the internal construction of the invention. The inner core 50 is surrounded by a durable outer layer 51. The inner core is preferably a carvable foam, but can be wood, composite or a similar material that helps to provide shape to the invention. The outer layer is preferably fiberglass resin and cloth, but can be any material that helps to provide a durable outer layer of adequate strength such as an injection molded plastic, a composite, a metal, carbon fiber, or any other similar material. Additional reinforcement for high stress areas may be desirable, depending on materials used. In the preferred embodiment, reinforcement material 52 is used in the trailing edge of the front section so as to reinforce the mating cavity which holds the connection assembly block. Reinforcement material is preferably a plastic that pours and molds into the desired shape, but can be any material that increases the strength and durability of the area, such as a high-strength plastic, composite, metal or any other similar material. A lengthwise band of the reinforcement material 48 is also used under strips 49, as shown in FIGS. 14 and 15.

Rear Section same as Front Section

FIG. 1 shows the rear section 56 to be a mirror image of the front section. Therefore, the description above of the front section applies also to the rear section except that the leading edge 57 of the front section is the trailing edge 61 of the rear section, and the trailing edge 59 of the front section is the leading edge 58 of the rear section. And the part numbers use "R" instead of "L" as a suffix.

Connection Assembly: Overview

Figure 20:
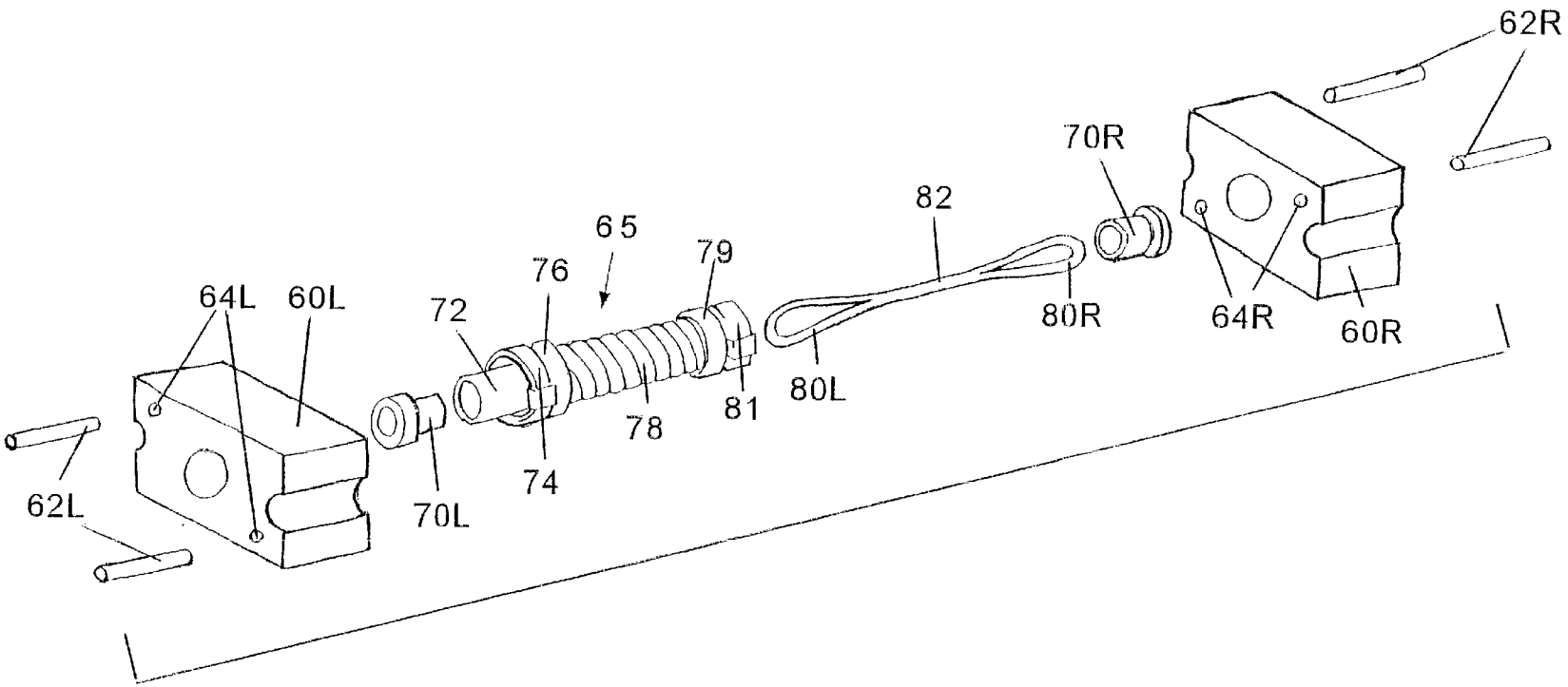
FIG. 20 is an exploded perspective view of the connection assembly of the present invention.

FIG. 20 illustrates the connection assembly. The connection assembly resists movement from its unstressed position. In addition, it is advantageous if it can be easily disconnected from the front and back sections for storage and replacement purposes.

Connection Assembly: The Innermost Cord Within the Tube

In FIG. 20, a cord 82, preferably constructed of a strong, flexible material such as stranded cable, with loops 80L and 80R at each end, is inserted into a flexible tube 72. The tube is preferably filled with a flexible filler material 86 such as silicon. Flanges 70L and 70R are inserted into front end and back end of tube 72, respectively.

Connection Assembly: Spring, Clamps and Block

The tube 72 is inserted into a spring 78. Circular clamps 74 and 76 are tightened around the front end of the spring. Circular clamps 79 and 81 are tightened around the rear end of the spring. Cord, tube, flexible filler, flanges, spring and circular clamps connect to form a spring assembly 65. The blocks 60L and 60R are preferably a moldable, rigid material such as plastic or resin.

Connection Assembly: Spring Assembly an Integral Part of Block

Figure 17:
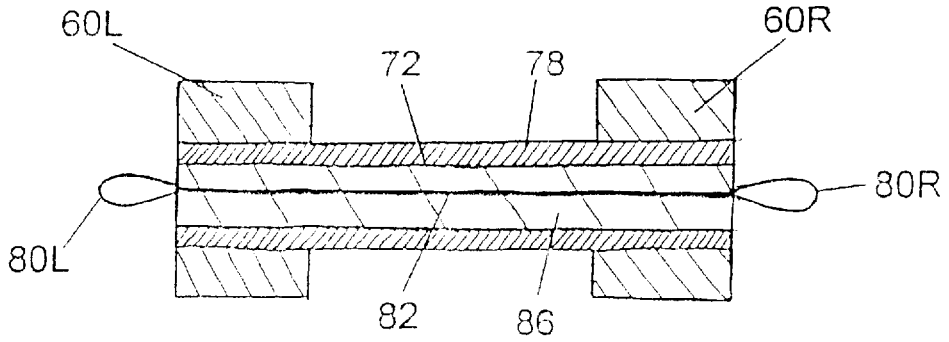
FIG. 17 is a longitudinal sectional view on the line 17—17 of FIG. 16.
Figure 18:
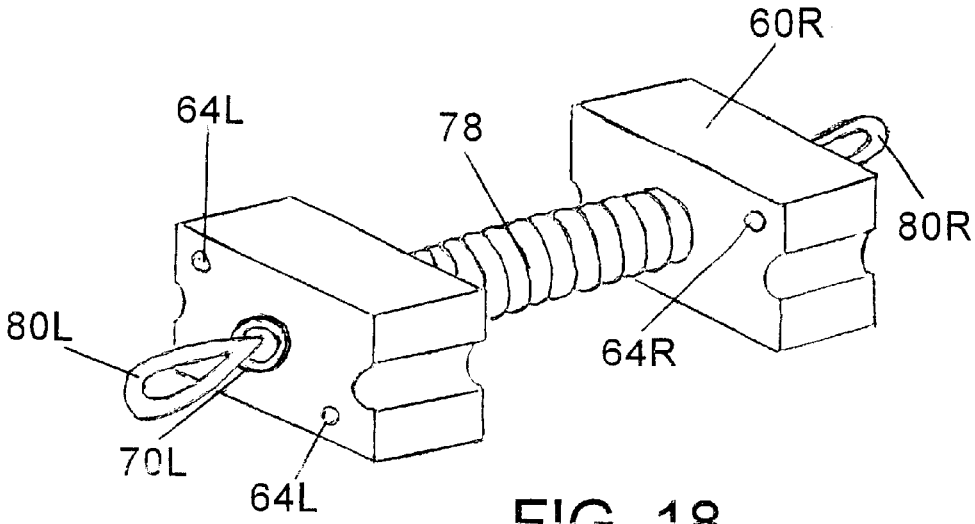
FIG. 18 is a perspective view of the connection assembly of the present invention.
Figure 19:
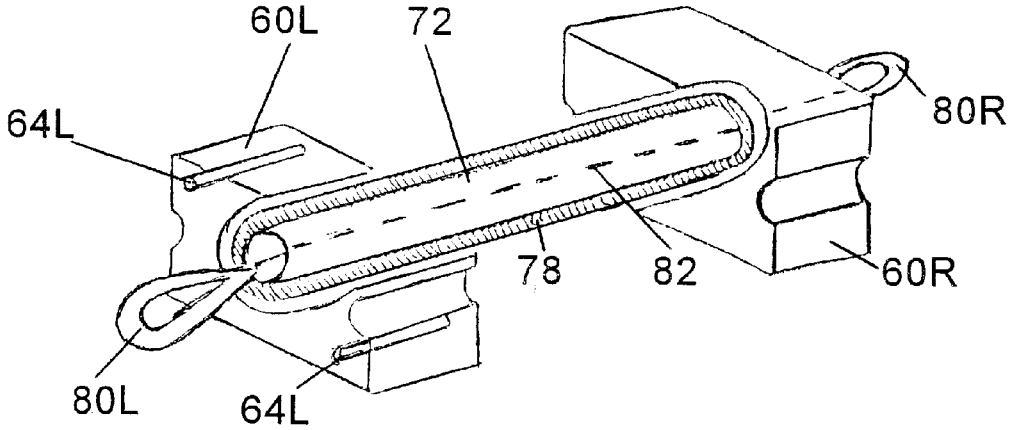
FIG. 19 is a cutaway perspective view of the connection assembly of the present invention.

The front end and rear end of the spring assembly are molded into block 60L and 60R, respectively. Making the spring assembly an integral part of the block anchors the spring assembly at each end and aims to prevent movement of the end of the spring in the direction of the coils, clockwise and counterclockwise. The purpose of the circular clamps now becomes apparent—they provide asymmetrical projections within the block to help prevent the spring assembly from twisting and breaking loose inside the block. Tubes 62L insert in holes 64L to prevent damage to block 60L from over-tightening of bolts 43L (shown in FIG. 1). FIG. 18 illustrates the connection assembly. FIG. 19 is a cutaway of the connection assembly, showing the relationship of the spring assembly and block. FIG. 17 is a longitudinal sectional view of the connection assembly.

Connection Assembly: Snow Barrier Covering on the Spring

Figure 16:
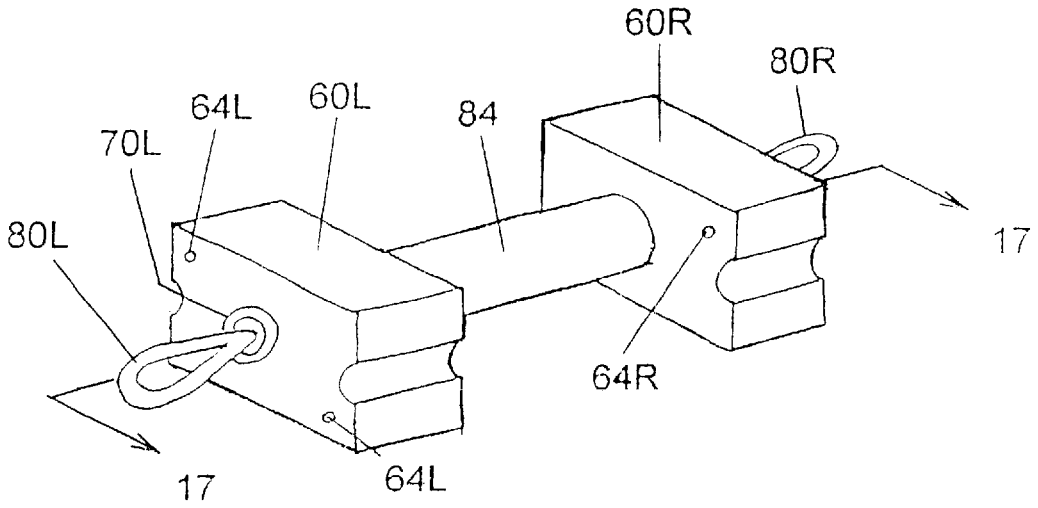
FIG. 16 is a perspective view of the connection assembly of the present invention, including the flexible sheath covering around the spring.

FIG. 16 illustrates a covering 84 over the spring, which may be made of rubber or other barrier to prevent snow from lodging between the coils of the spring.

Connection Assembly: Non-twistable

Figure 21:
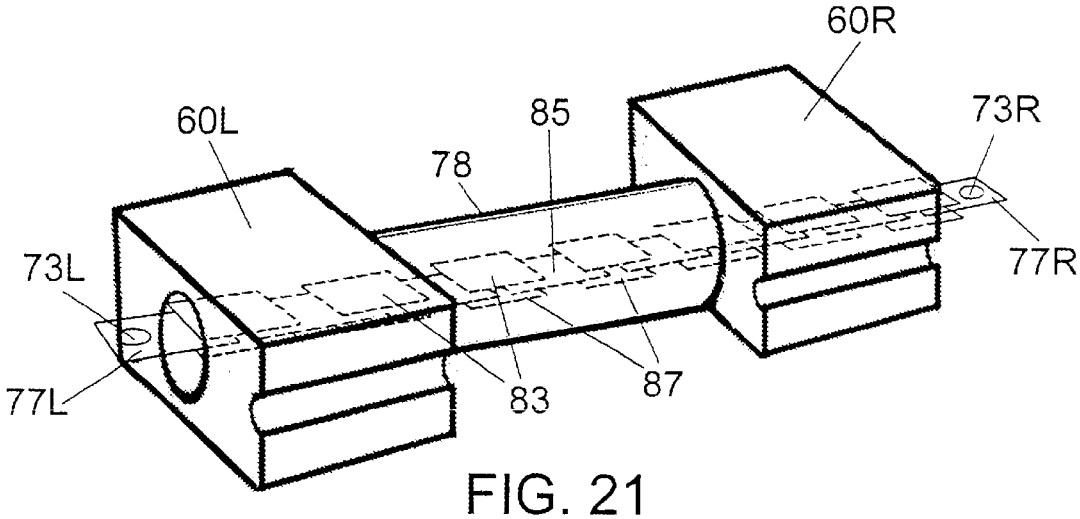
FIG. 21 is a perspective view of an alternative embodiment of the connection assembly of the present invention, using plates in place of the center cord.
Figure 22:
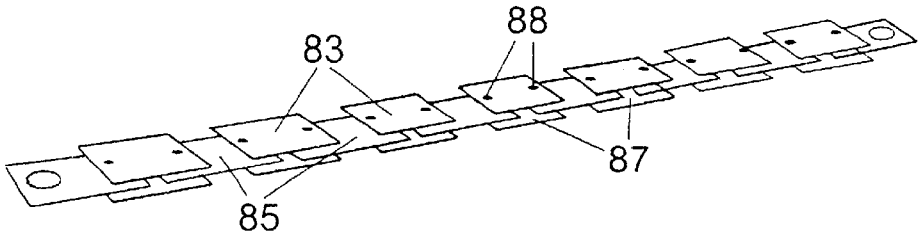
FIG. 22 is a perspective view of the plates in FIG. 21.
Figure 23:
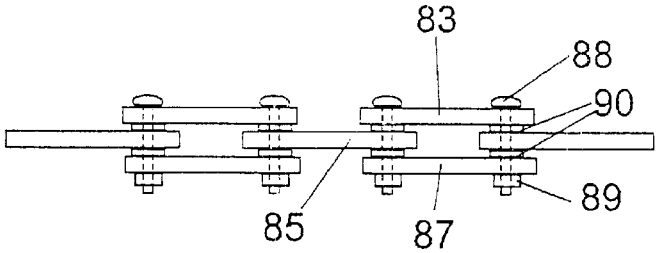
FIG. 23 is a fragmentary side view of the plates in FIG. 22.
Figure 24:
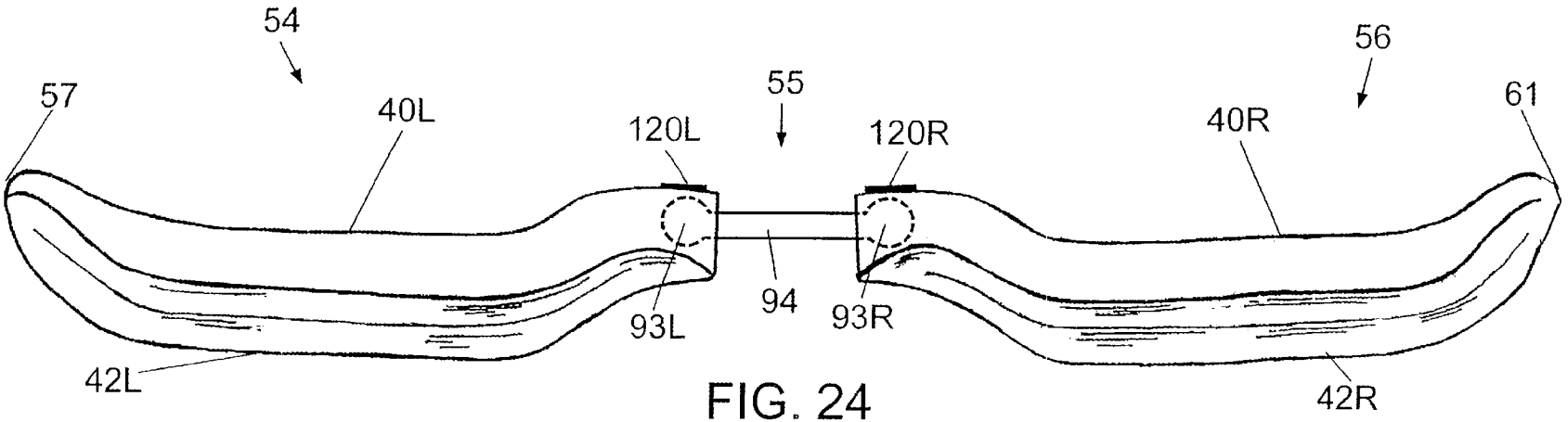
FIG. 24 is a side view of an alternative embodiment of the connection assembly of the present invention, using a ball and socket.
Figure 25:
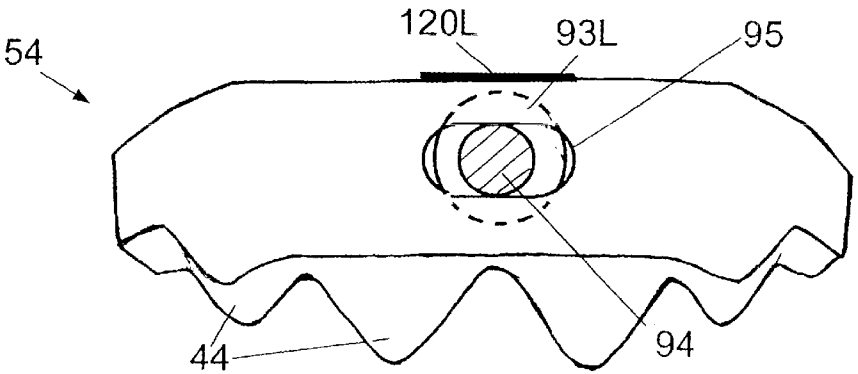
FIG. 25 is a rear side view of the front section of the alternative embodiment in FIG. 24.

FIGS. 21, 22 and 23 illustrate a non-twistable version of the connector. The cord 82 is replaced with a plate assembly, depicted in FIG. 22, comprised of preferably metal plates fastened with bolts or comparable fasteners. A bolt 88 passes through an upper plate 83, a washer 90, a middle plate 85, a washer 90, a lower plate 87, and a nut 89, respectively. The plate assembly is positioned within the connector as shown in FIG. 21. When attaching the connector to the front and back sections of the invention, the blocks 60L and 60R are inserted in the receptacles 45L and 45R, and the bolts 41L and 41R are inserted through a hole 73L or 73R of the connector and secured to the respective section.

Connection Assembly: Rigid Connector, Ball and Socket Joint

Figure 26:
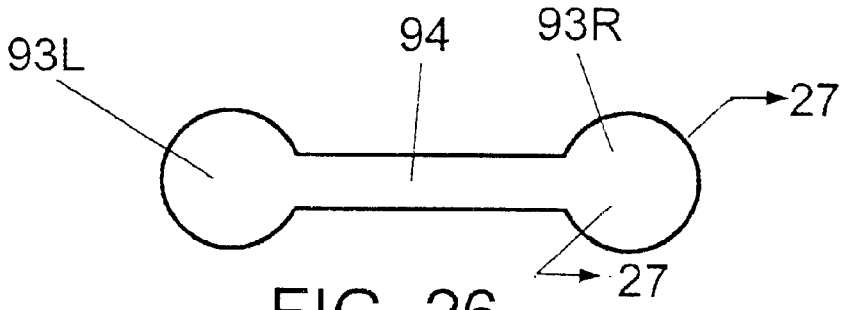
FIG. 26 is a side view of the connector of the alternative embodiment in FIG. 24.
Figure 27:
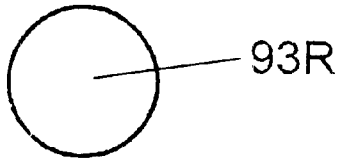
FIG. 27 is a sectional view taken on the line 27—27 of FIG. 26.
Figure 28:
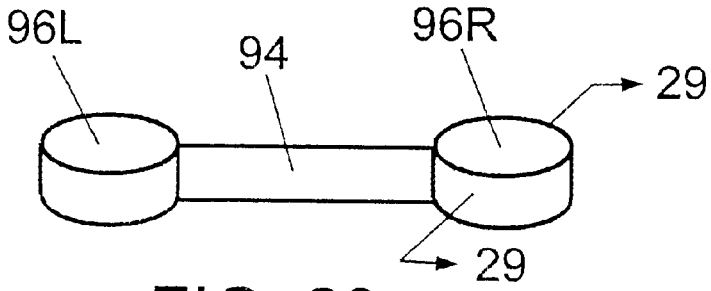
FIG. 28 is a side view of an alternative embodiment of FIG. 26.
Figure 29:
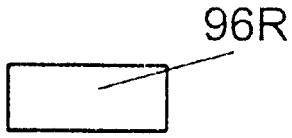
FIG. 29 is a sectional view taken on line 29—29 of FIG. 28.

FIGS. 24, 25, 26 and 27 illustrate a ball and socket joint that will provide motion in all directions with a rigid connector. The connector is a rod 94, preferably metal, with spheres 93L and 93R at each end, as shown in FIG. 26. A horizontal slot 95 allows the rod 94 to swing left to right, horizontally. The spheres allow the sections to twist around their longitudinal axis. The spheres 93L and 93R are held securely within each section with a door 120L or 120R. Vertical motion could be added by including a vertical slot. Or full range motion could be implemented with a funnel-shaped hole, with the sphere at the narrow end and the rod having the wide end of the funnel to move freely. FIGS. 28 and 29 illustrate a rigid connector for the ball and socket joint that would prevent twisting and would only allow movement in the horizontal plane. The spheres are flattened into discs 96L and 96R so that they will not move up and down, but only horizontally.

Attachment of Feet to Invention

Figure 30:
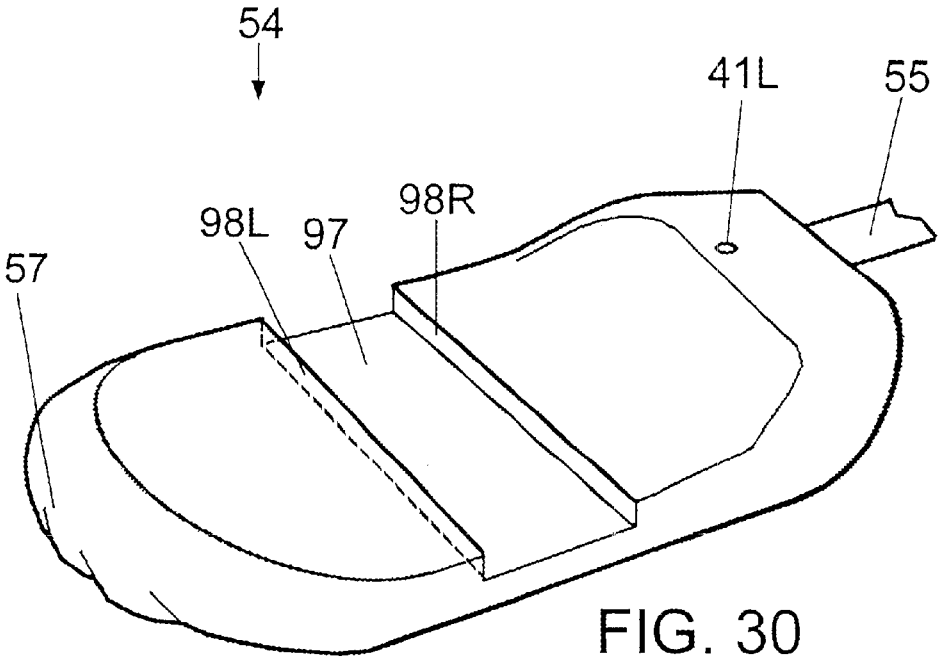
FIG. 30 is a perspective view of the front section illustrating an alternative embodiment of the top surface with a foot recess.
Figure 31:
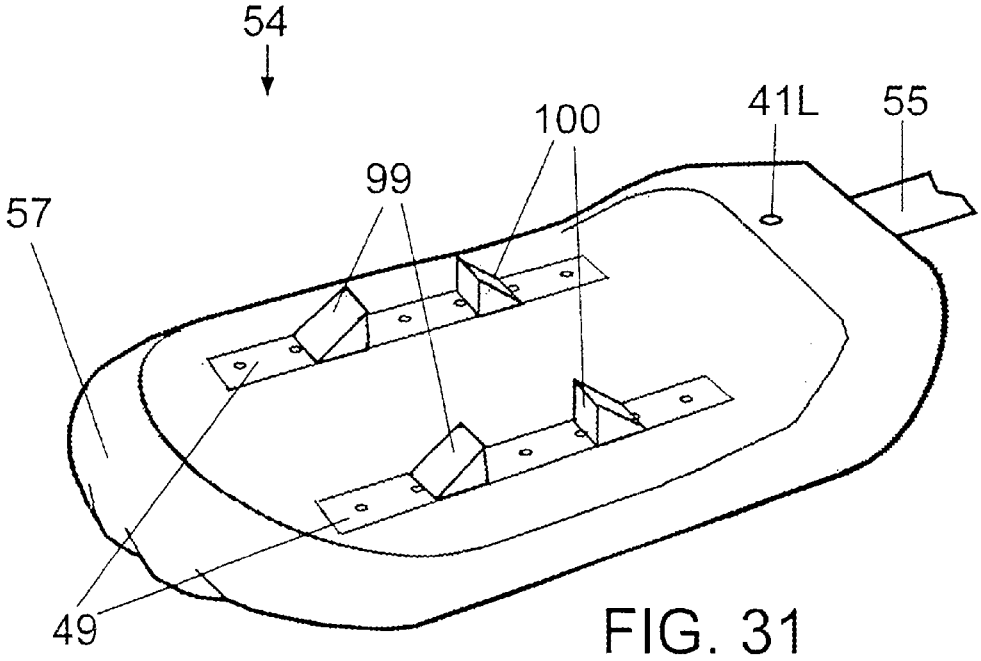
FIG. 31 is a perspective view of the front section illustrating an alternative embodiment of the top surface with foot restrainer wedges.
Figure 32:
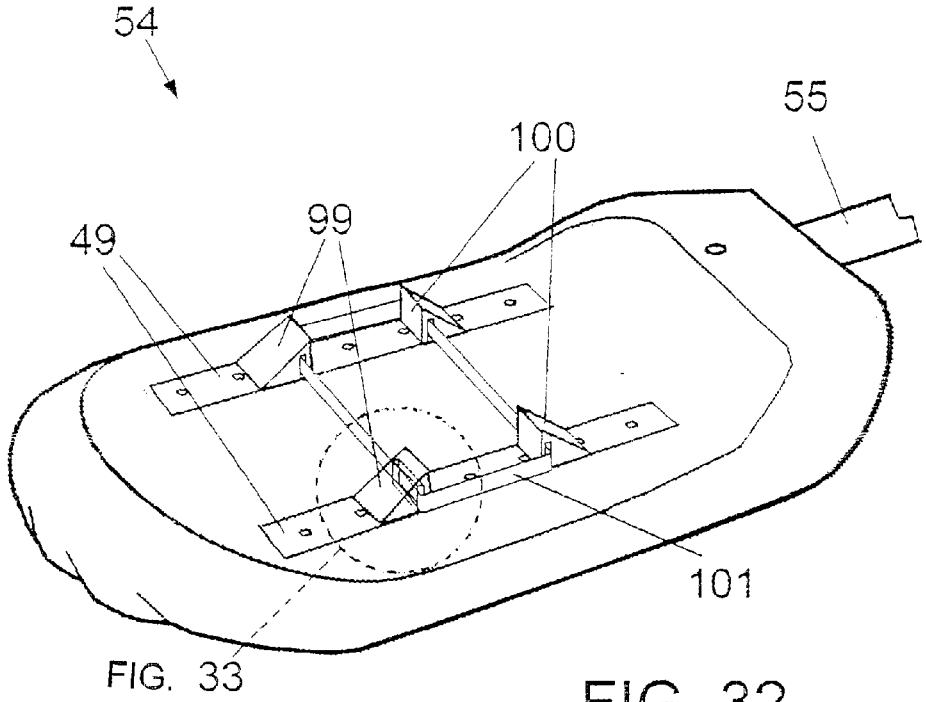
FIG. 32 is a perspective view of the front section illustrating an alternative embodiment of the top surface with foot restrainer band.
Figure 33:
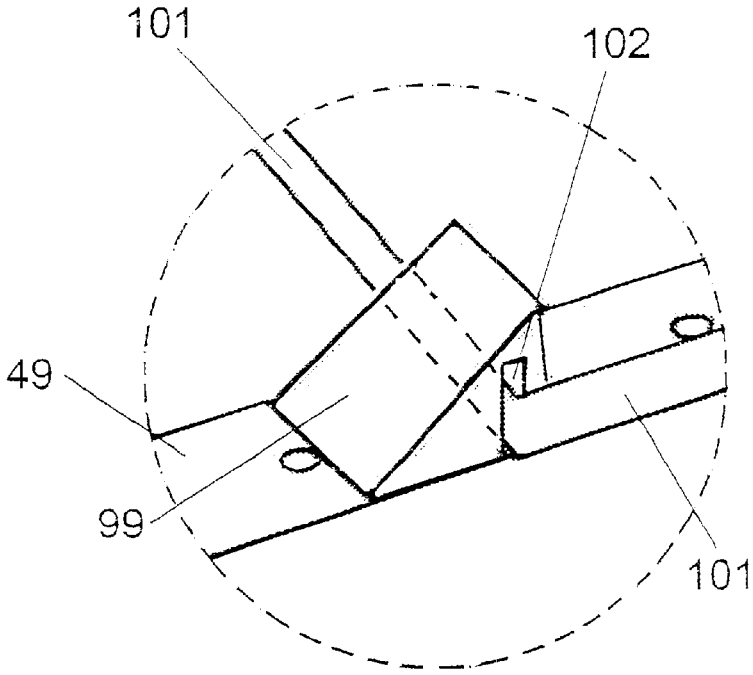
FIG. 33 is a perspective fragmentary view of the construction of the foot restrainer band in FIG. 32.
Figure 34:
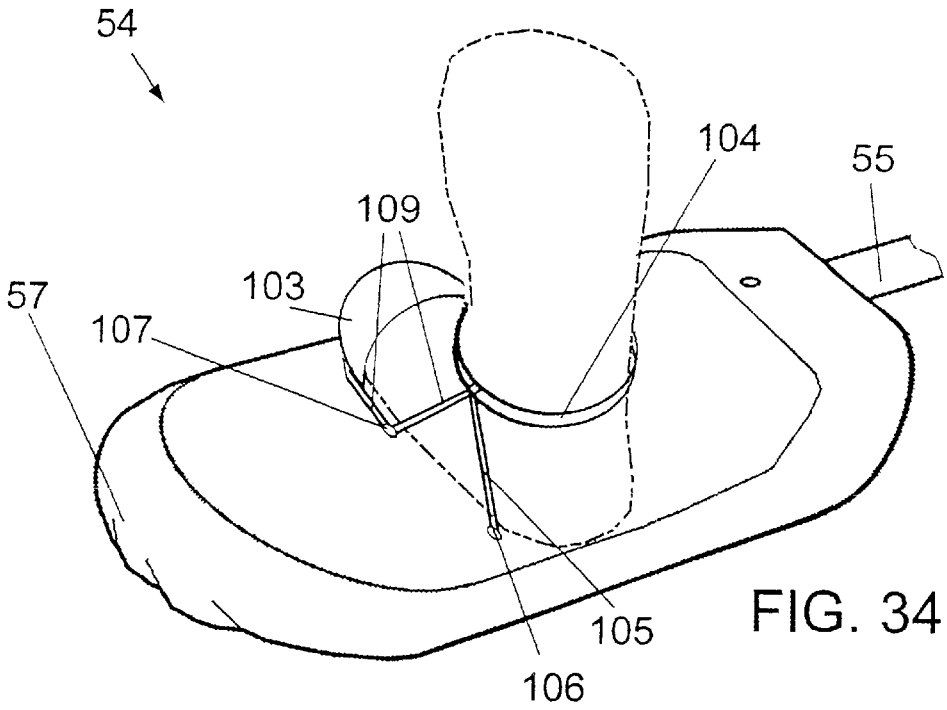
FIG. 34 is a perspective view of the front section illustrating an alternative embodiment of the top surface with foot restrainer cords.
Figure 35:
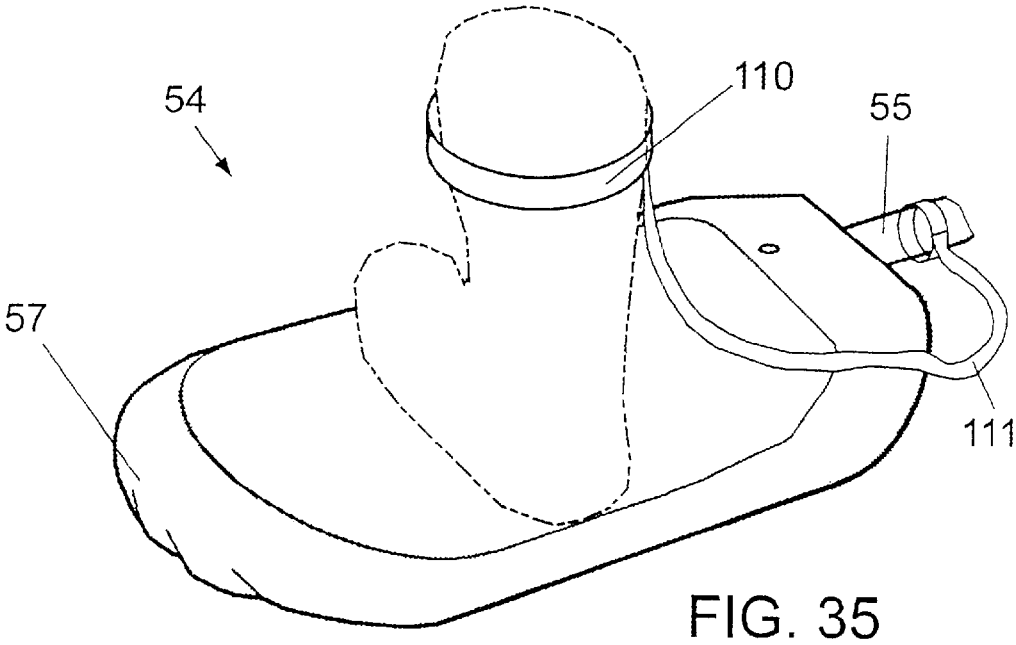
FIG. 35 is a perspective view of the front section illustrating a safety leash for the present invention.

To allow freedom of movement of the feet, the preferred embodiment does not secure or restrain the rider's feet to the surface of the board in any way. However, a rider may prefer to have one or both feet either restrained or secured to the surface of the invention, one foot on each section. A restrained foot is one which is not securely fastened, and which may be lifted vertically from the board so that it is not prevented from moving in a vertical direction; but which is preferably prevented from moving side-to-side or forwards-backwards by an enclosure. A minimum enclosure is depicted by FIG. 30 as a recess 97 having edges 98L and 98R in the surface of the section. The rider's feet are placed in the recess, preventing movement of the foot along the longitudinal axis of the section by contact with edges 98L and 98R. A similar effect could be accomplished by placing one or more blocks on each side of the foot, as depicted by FIG. 31, where wedges 99 prevent the foot moving towards the leading edge 57 and wedges 100 prevent the foot from moving away from the leading edge 57. FIG. 32 shows an encircling band 101, preferably a rubber-like material, which further restricts foot movement. The band 101 passes through a slot 102 in the wedges 99. FIG. 34 illustrates an enclosure 103 for the purpose of containing the front part of the rider's foot, which would restrict motion of the foot in the direction of the enclosure 103.

Safety Ankle Strap

FIG. 34 shows an ankle strap 104, which may be secured around the rider's ankle and attached to the board with two or more taut, flexible cords 105, 106, 107, and 109 for the purpose of holding the board in close proximity to the foot. The ankle strap is optional, but is recommended if the rider has elected to use a traditional binding on one of the sections. In the event of a fall, the ankle strap on the unsecured foot helps to keep that board section at the rider's feet, decreasing the chance of injury to head or body.

Safety Leash

The rider may use a safety leash which comprises a leg strap 110 around the rider's leg which is attached to the connector 55 with a short, but not taut, leash 111. The purpose of the safety leash is to prevent the board from sliding away from a downed rider and becoming a threat to others on the slope.

Turning the Invention

Figure 10:
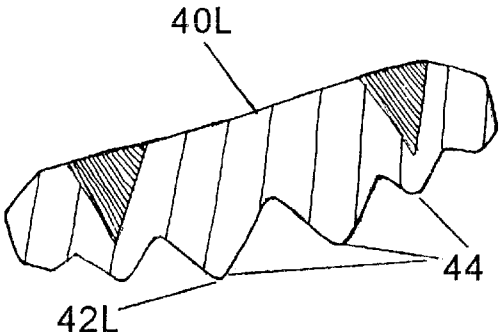
FIG. 10 is a sectional view taken on the line 10—10 of FIG. 9.
Figure 11:
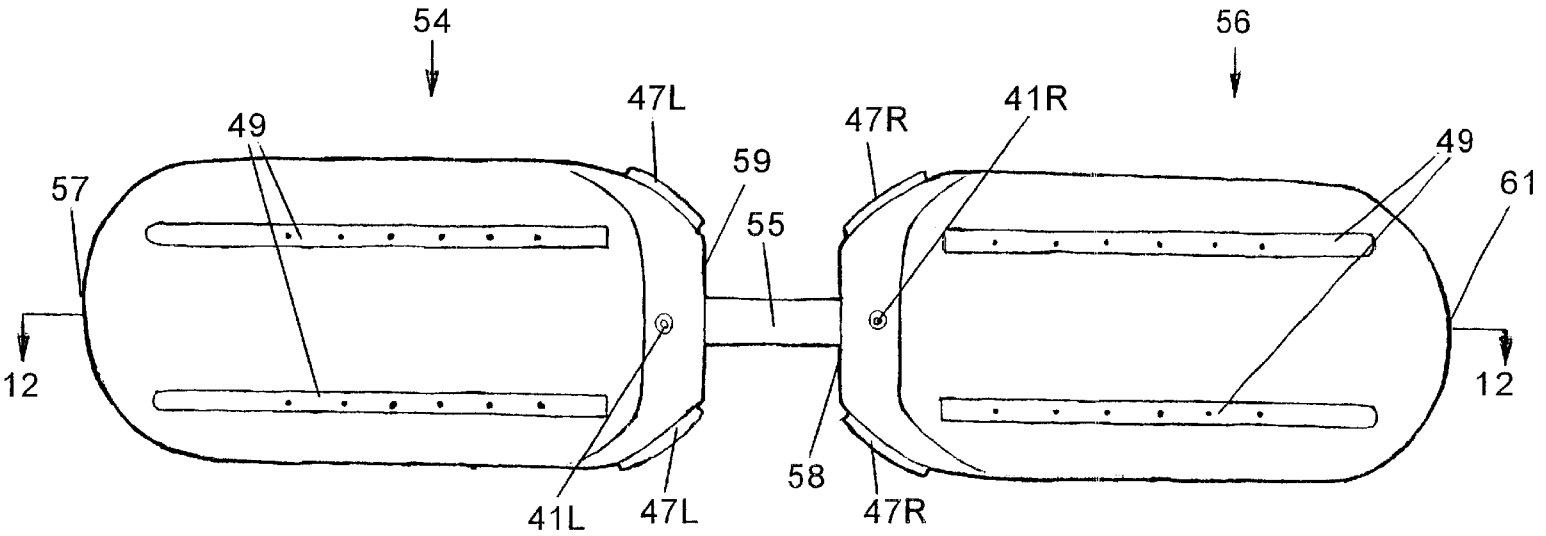
FIG. 11 is a plan view of the present invention.

A rider will place one foot on the front section of the invention and one foot on the rear section. Although the rider's feet will not be securely attached to their respective sections, they may have a means to prevent them from moving side-to-side or front-to-back. Traveling downhill over the snow, the rider can pivot his feet to point to the left or to the right, causing the board to pivot in the same direction. When the rider pivots his feet to point to the left, the board will turn to the left. When the rider pivots his feet to point to the right, the board will turn to the right. This turning tendency can be increased by embedding blades in the ridges. In addition, blades or ridges can be placed on the periphery of the sections at an angle to the longitudinal axis of the section, enabling the rider to further change his direction of travel by tilting the front or rear section about its longitudinal axis by shifting his weight left or right. When the rider's weight is shifted left, for example, that section's left side will tilt down as depicted in FIG. 10, engaging ridges or blades that are angled to the left, and increasing the tendency of the section to turn left. Similarly, when the section is tilted down on the right, blades or ridges that are angled to the right will make contact with the surface, increasing the tendency of the section to turn right.

The springable connection assembly facilitates the turning action by allowing simultaneous rotation about the vertical axis (left and right) and the longitudinal axis (tilting one side up and the other down). The rider can shift weight to the left and turn to the left simultaneously.

Stability

The springable connection assembly, when flexed, exerts a force against the flexion in an attempt to return to its unflexed state. This gives the invention a predictable stability. The sections will tend to stay in a straight line (an unflexed position), as illustrated in FIG. 7, unless the rider proactively moves them out of the straight, unflexed position, as depicted, for example, in FIG. 9 as a turn to the left.

Board Stability When a Rider is Standing on the Invention

When the rider stands on the invention, the sections retain their level, horizontal position. Neither the leading edge nor the trailing edge of either section moves downwards in relation to the center of the board, but remains level. This is apparently due to the shape of the bottom surface of the sections, the placement of the connection assembly with regards to the sections, the unflexed position of the connection assembly, and the distribution of the weight of the rider. There may be times when the rider will choose to purposely place the section in a non-level position by standing on the leading or trailing edge of a section to engage specially-positioned ridges or blades for the purpose of slowing or stopping the invention.

Spacers

Figure 9:
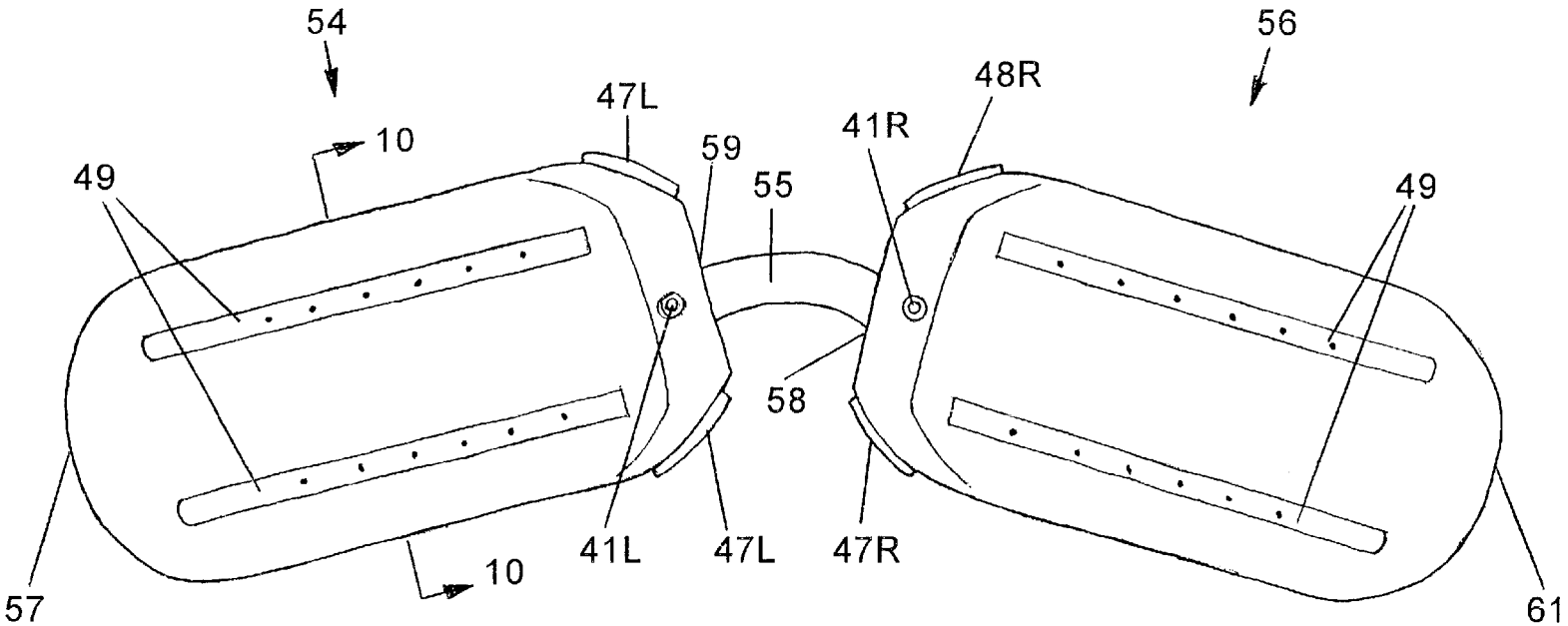
FIG. 9 is a plan view of the present invention as it would appear in a turn.

The angle between the front and rear sections in an unflexed state is 180 degrees. At times it may be important to control the angle of flex so that the angle between the sections does not vary by more than approximately 70 degrees to the right or left. If the front section flexed to the left by 70 degrees, the angle between it and the rear section on the left side would be 110 degrees. It is conceivable that, while traveling at high speed down a hill, one of the sections of the invention could deflect off of terrain and snap back at an angle more acute than approximately 110 degrees, upsetting the rider. To aid in avoiding this type of event, the invention has spacers. Referring to FIG. 9, spacer 47L and 47R would extend outward away from the front and rear sections, respectively. If the front section is flexed to the left beyond a certain angle, the spacer of the front section on the left trailing edge would hit against or make contact with the spacer of the rear section located on the left leading edge. The spacers would extend outward to a length that would cause them to make contact and attempt to prevent the invention from flexing closer than an angle of approximately 110 degrees between the sections. The number 110 degrees is used for illustrative purposes only. The angle of flex may be more or less than 110 degrees, depending on the performance capabilities of the invention, the skill of the rider and the height of the rider.

Ease of Connecting/Disconnecting Sections

It is desirable to be able to easily connect and disconnect the sections. To this end, the blocks of the connection assembly are secured with only three bolts, easily removed by the rider. Bolts 43L and 43R are the primary connectors for securing the connection assembly to the front section and rear section, respectively. However, if the rider either intentionally or unintentionally performs an extreme maneuver causing these primary bolts to fail, there is a backup connection system: Bolts 41L and 41R are threaded through the end loops 80L and 80R of the connection assembly.

Interchangeable Springable Connection Assemblies

The performance characteristics of the invention can be modified by using connection assemblies with different flex characteristics. The preferred embodiment uses a spring in the connection assembly. Connection assemblies with different performance characteristics can be created by varying number of coils, thickness of coils, type of material and shape of coils, and other parameters which affect the action of a spring. As an example of how spring characteristics would affect the invention: one would expect that a heavier board and rider would require a more rigid spring to get the same riding characteristics as a lighter weight board and rider.

Interchangeable Sections

Because invention performance can be modified by changing the characteristics of the front and rear sections, a rider may prefer one set of characteristics for the front section and another set of characteristics for the rear section. The rider can easily replace a front or rear section with a front or rear section having different characteristics. In fact, because the connection between front and rear sections may be identical and interchangeable, a rider can use a rear section from one sample of the invention as a front section or a front section to replace a rear section in another sample of the invention.

Modifications to Section Bottom that May Change Performance

Some of the characteristics of the invention that can be modified in order to change performance of the invention include: changing size, shape, contour and number of ridges on the front and/or rear sections; changing the convexness of the bottom of the front or rear section; changing the length of a section; making ridges deeper or more shallow; modifying ridges with undulations on the ridges or ridges on the ridges; one or more ridges can also have embedded edges or blades made from steel or similar material to improve their ability to cut into the snow for better turns; these edges can protrude from part of the ridge or the entire ridge; a section may have these edges protruding from all ridges or only some of them. The sections may be identical mirror images as described in the preferred embodiment, or they may differ in shape and/or size.

Alternate Embodiments of Board Shape as Viewed from Above

FIG. 3 illustrates the board shape as viewed from the bottom, approximating an oval shape, with the leading and trailing edges being somewhat mirror images of one another. Alternate embodiments of the board shape as viewed from the bottom may have the leading edge of a section be differently shaped than the trailing edge of the section. For example, the width of the front section at the trailing edge could be less than the width of the front section at the leading edge. FIG. 6 illustrates this shape. In addition, the outline shape of either the leading or trailing half of the section could be different than depicted. For example, the outline shape of the leading edge of a section could include but not be limited to being more angular, such as the bow of a boat, rather than rounded as depicted in FIG. 3. Alternate Embodiment of Lateral Cross Section FIG. 8 illustrates a cross section of the preferred embodiment of the invention. An alternate embodiment of the board has a smaller or greater distance between the top surface and the bottom surface of a section.

Alternate Embodiments of Bottom Surface

Number of Ridges. As indicated, the bottom surface can have two or more than two ridges.

Depth of Ridges. The ridges can vary in depth, which is defined as the distance from the bottom-most edge to the uppermost point of the ridge. Described another way, looking at the cross-section "V" shape of a ridge, the depth would be measured from the bottom of the "V" to the top of the "V".

Partial Ridge Coverage Longitudinally. The ridges may extend the entire length of the board, from front to back, or they may extend over only a portion of the lengthwise distance. For example, a ridge could be only half the length of the board, starting from ¼ back from the leading edge and extending to ¾ back from the leading edge. Or a 2 inch ridge could be located close to the leading edge and another 3 inch ridge could be located back by the trailing edge.

Ridge Construction. The ridges can be made of a material similar to the rest of the invention, or one or more ridges can consist of another material, or be constructed of multiple materials. Ridges may have sharper, better-cutting edges by incorporation of a vertical blade made of metal or similar material.

Cross-sectional Shape of Ridges. The cross-sectional shape of the ridges as described in the preferred embodiment is triangular. This shape could be some other shape such as trapezoidal, rectangular, or curved (such as convex or concave-sided triangle or other polygon).

Ridges Placed on the Board for the Purpose of Turning. Ridges may be used for turning. Ridges used for turning will preferably placed on the periphery of a section and may vary in size, length, quantity, placement and construction.

Ridges Placed on the Board for the Purpose of Slowing or Stopping. Ridges may be used for slowing and/or stopping. Ridges designed to slow or stop the board would preferably be placed in opposing pairs (one ridge turned to the left and one to the right), or as one or more ridges placed approximately perpendicular to the longitudinal axis of the section. They could be located on the periphery of the board, so that when the rider pushed the periphery down to engage the surface, the ridges would slow or stop the board. They could also be located elsewhere on the board and designed to drop down and engage when the rider's foot pressed an engagement mechanism. As noted previously, the ridges used for slowing or stopping could consist partly or entirely of a rigid material such as metal.

Ridges Summarized. In summary, ridges can be combined in a variety of ways, including varying uses, quantities, depths, lengths, sharpness, shapes, location on board, construction and composition.

Other Bottom Surface Additions for the Purpose of Increasing Friction. A shape or material other than ridges can also be added to the bottom surface to increase friction under certain situations. This could be desirable, for example, on the far right or left side of the undersurface of the board, so that when that side of the board is tilted down, the friction on the side is increased, increasing drag and aiding in the turn towards that side. It may also be placed on the front or back of a section to improve braking action.

Removably Secured Bottom Surface Ridges or Additions.

Ridges or bottom surface additions may be designed to be removable and/or changeable to allow users to customize the bottom surface of each section. For example, ridges set at a greater angle from the longitudinal axis would provide a rider with more extreme turning capabilities.

Alternate Embodiments of the Connection Assembly

The connection assembly as described in the preferred embodiment is a single, springable connection assembly.

Number of springable connection assemblies. More than one springable connection assembly may be used to provide a less movable attachment between front and rear sections.

Dimensions of connection assembly. The length and girth of the connection assembly may vary. It could be as wide as the width of the front and back sections, or very narrow. Although its length may be from approximately 3 inches to 5 inches long, it may be less than 3 inches or greater than 5 inches.

Non-springable, flexible connection. The connection assembly of the preferred embodiment dynamically returns to its unflexed position. Some characteristics of the springable connector could be obtained by using a thick, rubber connector. Alternately, the connection, when flexed, could remain in the flexed position and not seek to return to move from the flexed position, such as a bendable material that remains in whatever position it is placed. Or the connection, when flexed, could be easily moveable to another position, such as a ball-and-socket joint or a pivoting joint such as a universal joint.

Connection flexible in one plane only. The connection could be made to flex in only one plane, rather than be flexible in all directions. For example (a) the springable connector with internal plate assembly depicted in FIG. 21, (b) a connector capable of flexing in more than one plane, but which is constrained so as to be movable in only one plane such as a ball and socket joint restricted to move in only the horizontal plane as depicted FIGS. 24, 25 and 28.

Rigid connector. There may be situations where a rigid connector is preferable, such as when performing stunts or for the beginner who does not want to have independently moveable sections.

Rigid connector flexibly connected to section. One or both ends of a rigid connector could each be flexibly connected to its respective section. For example, the connector could be a rigid shaft connected into each section with a ball-and-socket joint such as that depicted in FIGS. 24 and 25.

Alternate Embodiments of Springable Connection Assembly Construction

Alternately, the springable connection assembly can be made of fewer parts. It's most basic form would be a spring or non-springable connector whose ends were shaped so as to be directly connectable to the front and rear sections of the invention. The next level of complexity would be the spring or non-springable connector secured to a one-piece mating block. The springable connector of the preferred embodiment flexes in both the horizontal and vertical direction. Alternately, the connector may flex in only one plane with no twisting. A connector may also comprise one or more hinges in the center and/or at each end of the connector. A connector may be flexible or rigid with connections to each section of the board that are flexible. These connections may include but are not limited to hinges, ball bearing joints, universal joints.

Block. The purpose of the block of the preferred embodiment is multiple: its rectangular shape prevents the connector from twisting, and it provides a universal connection to any front or rear sections. However, these functions could be provided by a variety of other constructions: for example, the trailing edge of the front section of the invention could provide a strong, metal sleeve, much smaller than the current block. And the connection assembly could be reduced to a spring with a welded attachment that slipped into the sleeve.

Springable part of the connector. Rather than using a spring, the springableness of the connector could be provided by a combination of rods and springs, springable rods alone or multiple springs or a thick rubber shaft or similar type of springable material.

Alternate Embodiments of Spacers. The purpose of the spacers is to limit the angle of flex between the front section and the rear section of the invention. This result could also be accomplished with a device around, in or as an integral part of the connector so that the movement of one section with respect to the other would be limited. The limiting device could also be located on one or both sections.

Alternate Embodiments of Materials of Construction Invention may be constructed of any number of appropriate materials, including carbon fiber, fiberglass, plastic, metal, wood, foam and composite. The preferred embodiment of the invention provides numerous reinforcements. It is envisioned that when materials strong enough to withstand the forces under use are used, many such reinforcements may not be required. For example, the strips 49 along the upper surface of front and rear sections can be eliminated if the internal strength of the invention is adequate.

Conclusions, Ramifications and Scope

Accordingly, the reader will see that, due to its two-piece, articulated construction, the convex shape of the bottom of each section, the longitudinal ridges on the bottom surface, and the springable connection between the front and rear sections, this invention offers a rider capabilities not heretofore experienced. The term "approximately convex" is used in the claims herein to mean largely convex, but also possibly including some flat or even slightly concave portion along a minor part of the lower surface.

Maneuverability is enhanced by the two-piece construction, the springableness of the connector, the shape of the bottom and the ridges on the bottom. When the ridges incorporate blades made of metal or similar material, the rider will be able to easily make controlled turns around even moguls.

The connection assembly is constructed to mate with a variety of sections, and sections can easily be interchanged, giving a rider a wide variety of performance choices. In addition, the rider can add, remove or move turning ridges, further increasing choices. The invention can be easily dismantled into sections and connection assembly for easy transport and storage.

The advantages of this invention over previous snow riding boards and skis are as follows:

Two piece construction means increased maneuverability

Convex bottom glides over and around bumps and moguls

Longitudinal ridges provide maneuverability and control

Ridges placed at any angle to the longitudinal access provide more aggressive turning capabilities Springable connector contributes to stability and control Interchangeable parts means more performance options for the rider at lower cost Ability to ride invention without the use of traditional bindings allows more freedom of foot movement and therefore greater control While the above-mentioned specifications are directed to a snowboard, the same structure and characteristics could be used in a waterboard.

Thus, the foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A sportsboard for movement along a surface comprising:

a first section having an upper surface including a first section foot rest area and a lower surface, an outer end and an inner end, a right side and a left side, said first section having a first section longitudinal axis and a first section lateral axis said lower surface being approximately convex in shape along both said first section longitudinal axis and said first section lateral axis and said lower surface of said first section having a plurality of downwardly directed ridges extending longitudinally along a majority of said lower surface spaced from said right side and said left side and a plurality of said ridges contact said surface when the sportsboard is moving in a straight line;

a second section having an upper surface including a second section foot rest area and a lower surface, an outer end and an inner end, a right side and a left side, said lower surface being approximately convex in shape along both said second section longitudinal axis and said second section lateral axis and said lower surface of said second section having a plurality of downwardly directed ridges extending longitudinally along a majority of said lower surface spaced from said right side and said left side and a plurality of said ridges contact said surface when the sportsboard is moving in a straight line; and a flexible connector for connecting said inner end of said first section to said inner end of said second section.

2. The sportsboard of claim 1, wherein said sports board is a snowboard.

3. The sportsboard of claim 1, wherein said flexible connecter has at least one point of attachment to said inner end of said first section and at least one point of attachment to said inner surface of said second section and at least one of said points of attachment is a flexible point of attachment.

4. A sportsboard as in claim 3, wherein said flexible point of attachment is a ball-and-socket joint.

5. A sportsboard as in claim 1, wherein the lower surface of at least one of said first and second sections further has at least one angled protrusion positioned at an angle to the longitudinal axis of the section to facilitate movement, turning or braking of said sportsboard.

6. A sportsboard as in claim 5, wherein at least one of said angled protrusions includes at least one sharp edge.

7. A sportsboard as in claim 1, wherein said flexible connector includes a helical spring.

8. A sportsboard as in claim 1, wherein said first section foot rest area has means to prevent a user's foot from moving forward-backward along the longitudinal axis of said first section, whereby said means allows said foot to be lifted vertically from said first section.

9. A snowboard for movement along a snow covered surface comprising:

a first section having an upper surface including a first section foot rest area and a lower surface having a right edge and a left edge, an outer end and an inner end, said first section having a first section longitudinal axis and a first section lateral axis said lower surface of said first section having a plurality of longitudinal protrusions separated by longitudinal valleys, a majority of said longitudinal protrusions being curved along a majority of a distance between said first section outer end and said first section inner end and said plurality of longitudinal protrusions being positioned inwardly with respect to said right edge and said left edge and a plurality of said longitudinal protrusions also being positioned to contact said snow covered surface when the snowboard is moving downhill in a straight line;

a second section having an upper surface including a second section foot rest area and a lower surface having a right edge and a left edge, an outer end and an inner end, said second section having a second section longitudinal axis and a second section lateral axis said second section lower surface having a plurality of longitudinal protrusions separated by longitudinal valleys, said longitudinal protrusions being curved along a majority of a distance between said outer end and said inner end of said second section and said plurality of longitudinal protrusions being positioned inwardly with respect to said right edge and said left edge; and a connector for connecting said inner end of said first section to said inner end of said second section and wherein said plurality of longitudinal protrusions on said lower surfaces of said first and second sections comprise at least two inner protrusions and at least two outer protrusions and said at least two inner protrusions extend further downwardly than said at least two outer protrusions.

10. The snowboard of claim 9 wherein the lower surface of said first section and the lower surface of said second section further include at least one blade positioned between said protrusions and said right edge and at least one blade positioned between said protrusions and said left edge.

11. The snowboard of claim 10 further including at least one blade aligned along a bottom tip of at least one protrusion on said first section and at least one protrusion of said second section.

12. The snowboard of claim 10 wherein said at least one blade on each section is a pair of angled out stopping blades extending below said lower surface of each section.

13. The snowboard of claim 9 wherein said connector is removable from at least one of said inner ends whereby the snowboard can be disassembled into two separate pieces.

14. The snowboard of claim 13 wherein said connector is removable from both of said inner ends whereby the snowboard can be disassembled into three pieces.

15. The snowboard of claim 9 wherein said first and second sections are fabricated from a foam core covered with a rigid shell.

16. The snowboard of claim 9 wherein said connector is fabricated from a helical spring surrounding a flexible cable including a cable loop at each end, said rigid spring being affixed to each end to a male fitting and wherein the inner ends of said first and second sections include a mating female recess and a passageway for a securement pin which is aligned to pass through said cable loops of said cable to secure the connector to the first and second sections.

17. The snowboard of claim 9 wherein said connector is fabricated from a plurality of pinned horizontal flat plates, each plate including pin openings at each end and wherein said plurality of pinned, horizontal flat plates has a first section end connected to said first section and has a second section end connected to said second section whereby said connector can turn but not twist.

18. The snowboard of claim 9 wherein said upper surface of at least one of said first and second sections includes a foot recess comprising a channel aligned with said lateral axis of each at least one of said first and second sections.

19. The snowboard of claim 9 wherein said upper surface of at least one of said first and second sections includes a plurality of foot movement preventing protrusions extending above said upper surfaces of said first and second sections oriented to prevent forward-backward foot movement along the longitudinal axis of said first and second sections.

20. The snowboard of claim 9 further including a safety leash connected at one end to said connector and connectable at a remote end to an ankle of a rider.

* * * * *